US005688039A

United States Patent [19]

Johnson

[11] Patent Number: 5,688,039

[45] Date of Patent: Nov. 18, 1997

[54] PIVOTING PROJECTION BEAM SAFETY HELMET

[76] Inventor: Lyndon F. Johnson, 4439 Brandon Dr., Delray Beach, Fla. 33445

[21] Appl. No.: 711,777

[22] Filed: Sep. 10, 1996

[51] Int. Cl.[6] ..... F21L 15/14

[52] U.S. Cl. ..... 362/106; 362/234; 362/285

[58] Field of Search ..... 362/106, 105, 362/107, 234, 250, 251, 282, 284, 285, 287; 2/5, 906

[56] References Cited

U.S. PATENT DOCUMENTS

| | | | |
|---|---|---|---|
| 3,793,517 | 2/1974 | Carlini | 240/60 |
| 3,963,917 | 6/1976 | Romano | 240/60 |
| 4,186,429 | 1/1980 | Johnston | 362/106 |
| 4,195,328 | 3/1980 | Harris, Jr. | 362/72 |
| 4,945,458 | 7/1990 | Batts et al. | 362/106 |
| 5,329,637 | 7/1994 | Walker | 362/106 X |

*Primary Examiner*—Stephen F. Husar
*Attorney, Agent, or Firm*—Alvin S. Blum

[57] ABSTRACT

A safety helmet has a battery operated, flashing rear light for wide angle visibility and a battery operated front light with a narrow projected forward beam to light the path being traversed. The front light pivots about a horizontal axis with manual control to adjust the attitude or inclination of the beam to enhance its utility.

18 Claims, 2 Drawing Sheets

PIVOTING PROJECTION BEAM SAFETY HELMET

BACKGROUND OF THE INVENTION (1) Field of the Invention

This invention relates to safety helmets and more particularly to hard shell helmets with flashing rear light and attitude adjustable forward directed light beam.

(2) Related Art

Helmets with a hard outer shell separated from the head by web suspension elements or resilient liner elements are well known. They are required equipment for motorcyclists, bicyclists, firemen, miners, and construction workers in many areas. They are recommended for use by skaters. With the introduction of in-line skates and the increased speeds they encourage, we are seeing more injuries to skaters. When they are out after dark, some of the accidents and injuries are due to failure to see obstacles in their path and failure to be seen.

Cyclists may have headlights on their vehicles, but these are easily stolen and they are not attitude adjustable. It is useful to be able to adjust the attitude of the forward light beam to selectively light the area of the approaching path as well as to direct the beam to left and right as desired, especially when approaching a turn.

For further safety on the road, it is desirable for helmet wearers to warn a motorist, approaching from the rear, of their presence. Reflectors are useful for this purpose, but are much less effective than a flashing light.

Although safety helmets with a focussed forward light beam are known (U.S. Pat. No. 4,195,328); and with flashing rear lights are known (U.S. Pat. No. 4,186,429), a safety helmet with a flashing rear light and adjustable forward light is not known. The forward beam on a helmet naturally turns with the head when making a turn.

SUMMARY OF THE INVENTION

It is accordingly an object of the invention to provide a safety helmet with a hard outer shell protectively spaced away from the head that is equipped with a forwardly directed projection beam that is attitude adjustable and a flashing rear light. The shell may be protectively and resiliently spaced away from the head by strap or tape elements or by resilient padding such as foam plastic.

The front and rear lights are so mounted on the helmet as to not impair the structural integrity of the shell in a collision. The front and rear lights may be incorporated in a common housing that attaches to the outer surface of the shell. Alternatively, the two lights may be separately mounted on the helmet. The lights may be powered by batteries mounted in or on the helmet. Alternatively, the batteries may be remotely mounted, such as on the belt of the user.

These and other objects, advantages, and features of the invention will become more apparent when the detailed description is considered in conjunction with the drawings, in which like reference characters are used to indicate like elements in the various drawing figures.

DETAILED DESCRIPTION OF PREFERRED EMBODIMENTS

Figure 1:
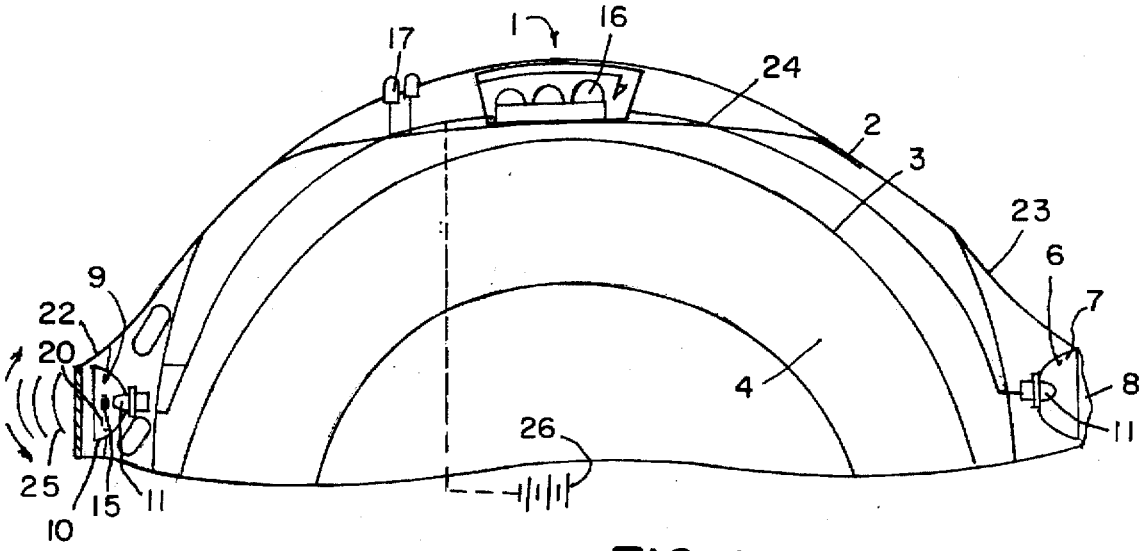
FIG. 1 is a sectional view of a helmet of the invention with separate front and rear light housings.
Figure 2:
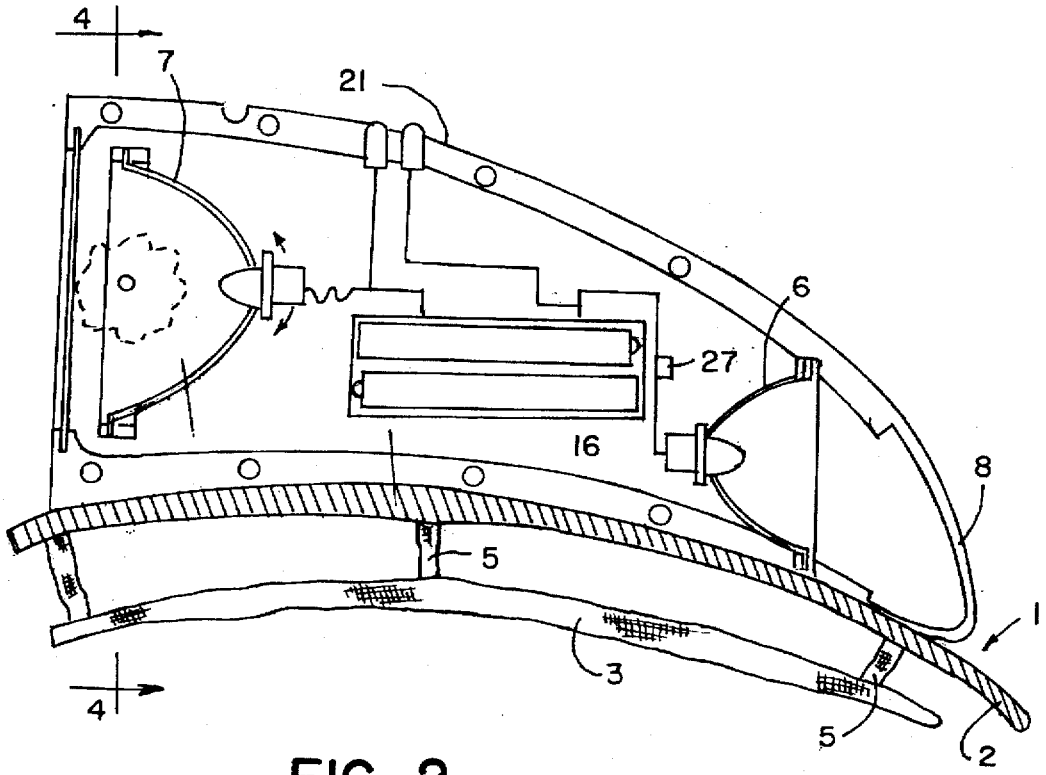
FIG. 2 is a sectional view of another embodiment of the invention with a portion of the helmet broken away.
Figure 4:
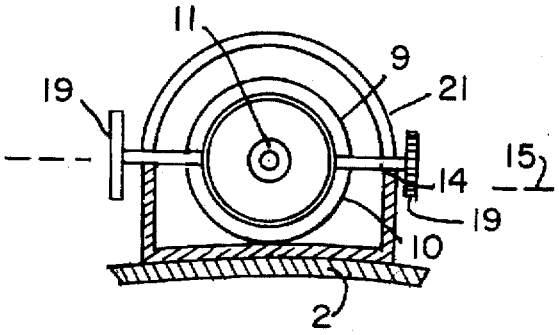
FIG. 4 is a sectional view taken on line 4—4 of FIG. 2.
Figure 3:
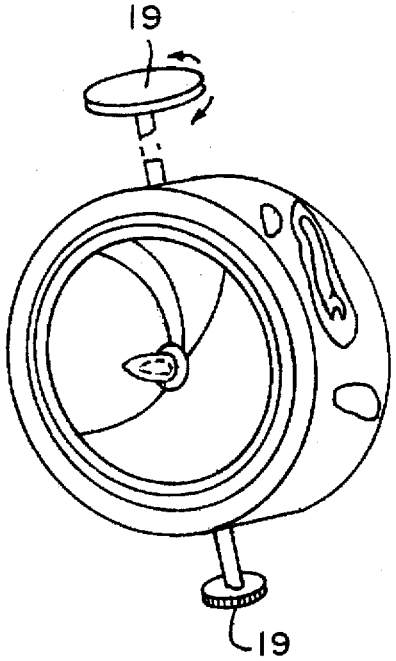
FIG. 3 is a front perspective view of the adjustable front light of FIG. 2.
Figure 5:
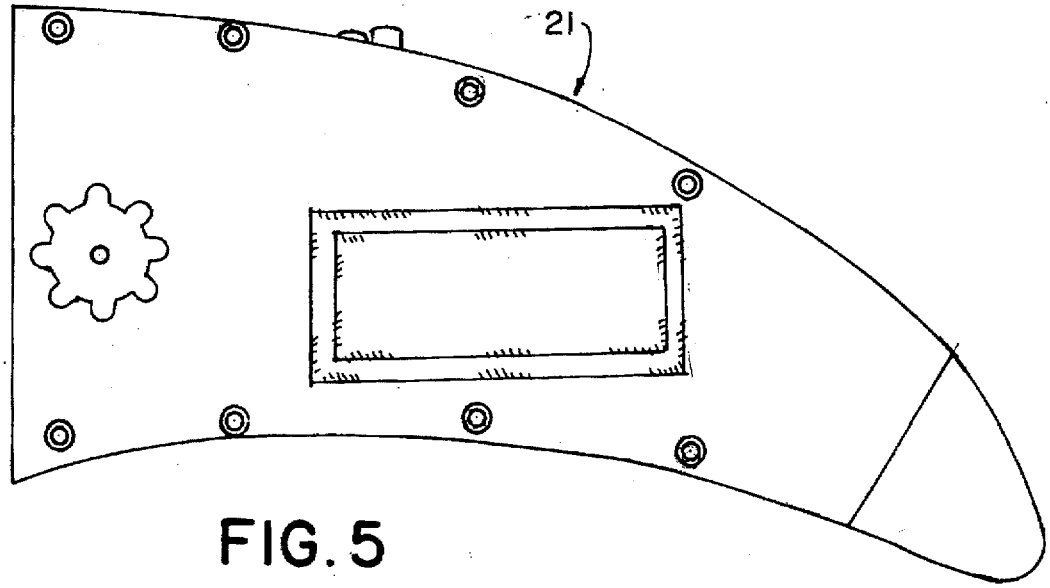
FIG. 5 is a side elevation view of the integral housing of FIG. 2.

Referring now first to FIG. 1, the safety helmet 1 is provided with a hard, impact resistant shell 2 with a resilient head-engaging liner 3 of foam plastic 4 of the type well known in the art. A set of batteries 16 under the shell is held in place by partition 24. A housing 23 external to the shell encloses a rear flashing light 6 with bulb 11 and reflector 7. A red diffusing lens 8 makes the rear light visible over a wide angle to approaching vehicles. It is fixed in position relative to the helmet. A front light 9 with bulb 11 and reflector 10 is pivotally mounted in front light housing 22 external to the shell. By mounting the front and rear lights external to the shell, there is no compromising of the integrity of the shell in shielding the wearer's head from external traumatic forces. The separate housings may be faired for enhanced aerodynamic function and appearance as shown. A lever 20 attached to the front light and external to housing 22 serves as a handle to permit manual adjustment of the inclination or attitude of the focused projection beam 25 so that it can be directed onto the path ahead as required by the user. Because the user may incline his or her head variably under different conditions of use, it is important to be able to adjust the light beam accordingly about a horizontal axis 15. As for directing the beam left or right, this is automatic since the user will want to illuminate the path in the direction the head is turned and the helmet and light will move correspondingly.

Although the batteries 16 may be held within the helmet, an alternative structure would locate the batteries 26 remote from the helmet, as shown in FIG. 1, with either location batteries connected to the front and rear lights by switches 17.

Referring now to FIGS. 2–5, an alternative embodiment of the invention positions the rear light 6 and the front light 7 within a common housing 21 which is mounted atop the hard shell 2 of the helmet 1. This helmet is shown with resilient head engaging means 3 in the form of bands or straps 5 as is well known in the art. Also contained within the common housing 21 is the electric power batteries 16 and switches 17 and well known flashing circuit 27 to cause the rear light to illuminate periodically at predetermined intervals for enhanced visibility and conservation of battery power. The rear light bulb and reflector 7 are mounted in a fixed position and its streamlined red lens 8 is of the diffusing type for wide angle visibility.

The front light 9 includes a bulb 11 mounted in a reflector 10. The reflector is pivotally mounted on horizontal axle 14 to the housing 21. A knob 19 is connected to the axle on each side of the housing so that the user can readily adjust the attitude of the projected light beam with either hand about the horizontal axis 15.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

What is claimed is:

1. An illuminated safety helmet for protecting the head of a user, the helmet comprising:

a hard shell;

resilient head-engaging means for engaging the head of a user and resiliently spacing the shell away from the head to cushion the head from forces applied to the shell, the head-engaging means attached to the shell at the inner surface thereof;

rearwardly directed intermittently electric powered rear light for flashing on and off at predetermined intervals;

forwardly directed electrically powered front light for directing a focused projection beam of light along the path to be taken by the user;

the rear light and front light being attached to the helmet in such a fashion as to maintain the protective integrity of the hard shell;

electric power means for supplying electric power to the front and rear lights connected to the front and rear lights;

means interposed between the power means and the front and rear lights for switching the front and rear lights on and off; and means for adjusting the attitude of the projection beam, the means for adjusting attached to the front light and extending outward therefrom to provide a handle for manual adjustment of the attitude of the beam by the user.

2. The helmet according to claim 1, in which the handle is a knob.

3. The helmet according to claim 1, in which the handle is a lever.

4. The helmet according to claim 1, in which the front and rear lights are both contained in a common housing that is attached to the shell.

5. The helmet according to claim 4, in which the electric power means are held within the housing.

6. The helmet according to claim 1, in which the front and rear lights are each contained in separate housings attached to the helmet.

7. The helmet according to claim 6, in which the electric power means are held within the helmet.

8. The helmet according to claim 6, in which the electric power means are held remote from the helmet.

9. The helmet according to claim 1, in which the electric power means are held remote from the helmet.

10. An illuminated safety helmet for protecting the head of a user, the helmet comprising a hard shell;

a resilient head-engaging means for engaging the head of a user and resiliently spacing the shell away from the head to cushion the head from forces applied to the shell, the head-engaging means attached to the shell at the inner surface thereof;

a rearwardly directed intermittently electric powered rear light for flashing on and off at predetermined intervals;

a forwardly directed electrically powered front light for directing a focused projection beam of light along the path to be taken by the user;

the rear light and front light being attached to the helmet in such a fashion as to maintain the protective integrity of the hard shell;

electric power means for supplying electric power to the front and rear lights connected to the front and rear lights;

means interposed between the power means and the front and rear lights for switching the front and rear lights on and off; pivotal mounting means mounting the front light on the helmet for adjustable rotation about a horizontal axis for attitude adjustment of the beam of light; and means for adjusting the attitude of the projection beam, the means for adjusting attached to the front light and extending outward therefrom to provide a handle for manual adjustment of the attitude of the beam by the user.

11. The helmet according to claim 10, in which the handle is a knob.

12. The helmet according to claim 10, in which the handle is a lever.

13. The helmet according to claim 10, in which the front and rear lights are both contained in a common housing that is attached to the shell.

14. The helmet according to claim 13, in which the electric power means are held within the housing.

15. The helmet according to claim 10, in which the front and rear lights are each contained in separate housings, attached to the helmet.

16. The helmet according to claim 15, in which the electric power means are held within the helmet.

17. The helmet according to claim 15, in which the electric power means are held remote from the helmet.

18. The helmet according to claim 10, in which the electric power means are held remote from the helmet.

* * * * *